US008931113B2

(12) United States Patent
Greer

(10) Patent No.: US 8,931,113 B2
(45) Date of Patent: Jan. 13, 2015

(54) LIFELINE ACCESS

(76) Inventor: Michael Alan Greer, North Royalton, OH (US)

( * ) Notice: Subject to any disclaimer, the term of this patent is extended or adjusted under 35 U.S.C. 154(b) by 104 days.

(21) Appl. No.: 12/755,399

(22) Filed: Apr. 6, 2010

(65) Prior Publication Data

US 2014/0075643 A1 Mar. 20, 2014

(51) Int. Cl.
*A41D 13/00* (2006.01)

(52) U.S. Cl.
CPC ..... *A41D 13/0007* (2013.01); *A41D 13/00* (2013.01)
USPC ..... 2/69

(58) Field of Classification Search
USPC ..... 2/94, 69, 79, 102, 108, 44–45, 327, 93, 2/456; 182/3–6
See application file for complete search history.

(56) References Cited

U.S. PATENT DOCUMENTS

| | | | | |
|---|---|---|---|---|
| 6,101,631 | A * | 8/2000 | Ferguson, Jr. | 2/94 |
| 6,487,725 | B1 * | 12/2002 | Jordan | 2/94 |
| 6,892,395 | B2 * | 5/2005 | Schweer | 2/94 |
| 7,356,850 | B2 * | 4/2008 | Turcotte et al. | 2/69 |
| 7,571,494 | B2 * | 8/2009 | Grilliot et al. | 2/69 |
| 7,707,660 | B2 * | 5/2010 | Grilliot et al. | 2/455 |
| 8,375,467 | B2 * | 2/2013 | Real et al. | 2/69 |

* cited by examiner

*Primary Examiner* — Tejash Patel

(57) ABSTRACT

In an exemplary embodiment of the invention, a jacket is provided having a lifeline access slot to allow a harness attachment to be accessed from outside the jacket. The access slot can be reinforced and designed to be barely visible but easily accessible.

14 Claims, 1 Drawing Sheet

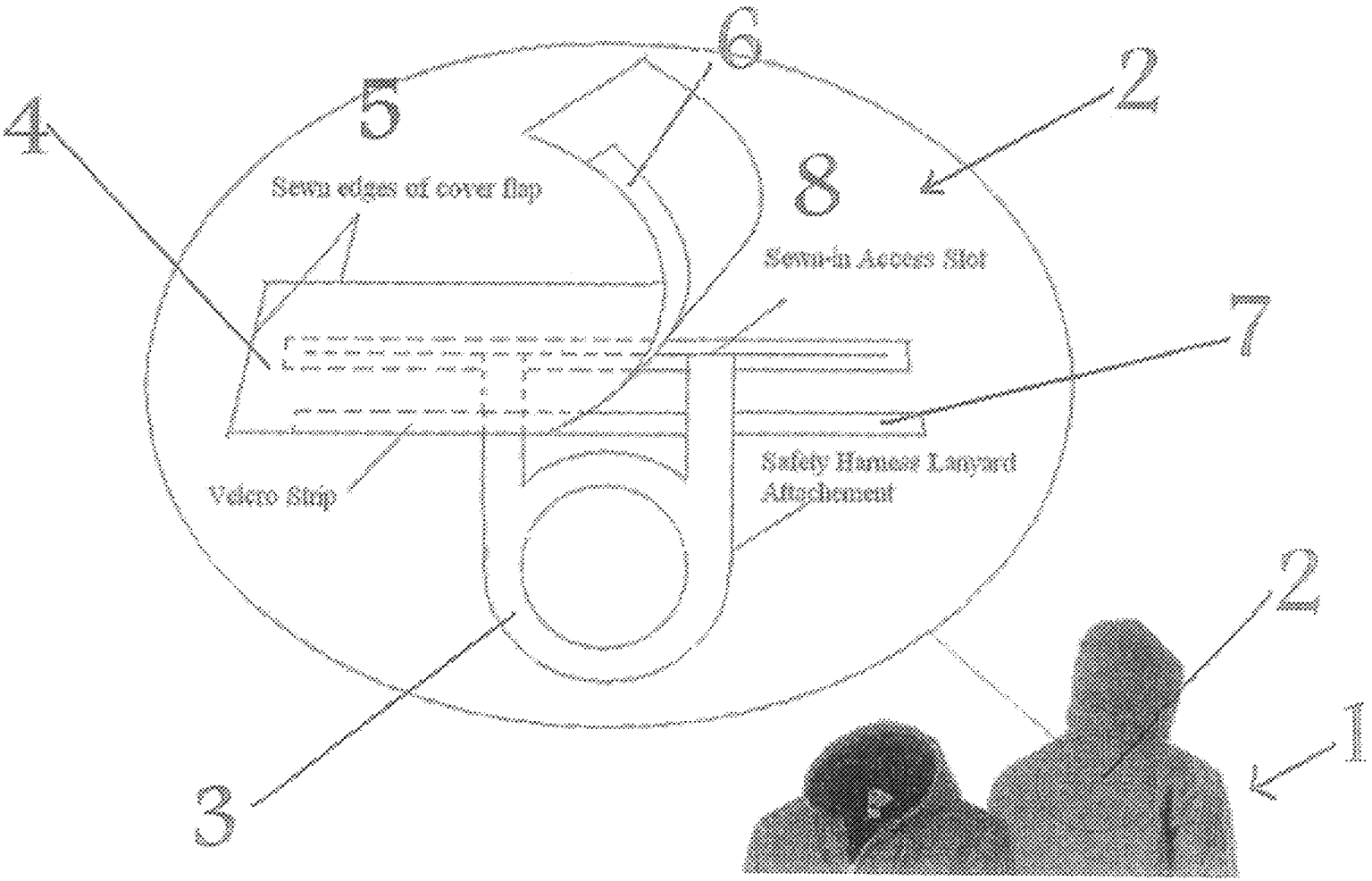
1
2
2
3
4
5
6
7
8
Semi-in Access Slot
Safety Harness Lanyard Attachment
Sewn edges of cover flap
Velcro Strip

LIFELINE ACCESS

BACKGROUND OF THE INVENTION

This invention relates to safety equipment clothing, and specifically to a jacket which allows a user to wear a protection harness underneath while permitting an attachment point outside the jacket.

In the construction industry, workers are often working in elevated or high altitude locations. Often, this required the use of safety or fall protection harnesses to prevent the worker from falling if he or she falls from their elevated position. This work is outdoors thus exposing the worker to the weather conditions. When the weather conditions are cold or rainy, the worker may desire to wear a coat or jacket. Coats and jackets can be cumbersome. Since the worker is required to wear safety harness, when weather conditions necessitate a coat or jacket, the worker is forced to wear the safety harness over his or her jacket or coat. This arrangement is uncomfortable and can restrict movement necessary in the physical duties required of the worker.

SUMMARY OF THE INVENTION

In an exemplary embodiment of the invention, a jacket is provided having a lifeline access slot to allow a harness attachment to be accessed from outside the jacket. The access slot can be reinforced and designed to be barely visible but easily accessible.

BRIEF DESCRIPTION OF THE DRAWINGS

The advantages, nature and various additional features of the invention will appear more fully upon consideration of the illustrative embodiment of the invention which is schematically set forth in the figures, in which:

FIG. 1 illustrates an exemplary jacket of an embodiment of the present invention.

DETAILED DESCRIPTION OF THE INVENTION

The present invention will be explained in further detail by making reference to the accompanying drawings, which do not limit the scope of the invention in any way.

FIG. 1 illustrates an exemplary embodiment of the present invention. A jacket 1 is shown having an access assembly 2. The access assembly 2 is located in the back side of jacket 1. There can be more than one access slot 1 and can be located in any location on the front, back or side of jacket 1. The access slot 1 is preferable located in a position that aligns with the location of d-ring 3 of the safety harness (not shown).

Typically, the safety harness is a series of reinforced belt-like strips of material having one or more d-ring 3 attachment devices. The present invention is not limited by the size, shape or location of the d-ring 3. The d-ring 3 can be any type of attachment device. Safety harnesses are well known in the industry and vary in size and shape. The present invention contemplates, but is not limited to, matching the location of the access assembly 2 with the location of any given safety harness. As a non-limited example, the safety harness discussed herein shall be presumed to have a d-ring 3 attachment device located in the center of the user's back in between the user's shoulders.

The access assembly 2 of FIG. 1 further includes a cover flap 4. The cover flap 4 would typically be of the same material and color as the jacket 1, however, the cover flap 4 can be any size, shape, color or material. The cover flap 4 covers the access slot 8. Access slot 8 is an opening which allows the safety attachment device 3 to be accessed from the outside of the jacket 1. In the preferred embodiment, the user would wear his safety harness and wear his jacket 1 over the safety harness. The attachment device 3 would slip through the access slot 8 so that the user could attaché the attachment device 3 to the safety cable.

The cover flap 4 can be attached to the jacket 1 in many ways. As shown in FIG. 1, portions of the edges 5 of the cover flap 4 are sewn to the jacket 1. This allows the cover flap 4 to be peeled back to expose the access slot 8. The cover flap 4 is not required to be sewn or permanently attached to jacket 1. The cover flap 4 may be attached to the jacket 1 in other ways such as by using Velcro, buttons, snaps, zippers or any other fastening means.

The cover flap 4 of FIG. 1 also includes a Velcro cover strip 6 on the underside of the cover flap 4. A matching Velcro jacket strip 7 is attached to the jacket 1 such that the cover strip 6 engages jacket strip 7 when the cover flap 4 is pressed against the jacket 4. The engagement of cover strip 6 with jacket strip 7 hold the cover flap 4 against the jacket 1 while still allowing the attachment device 3 to be exposed to the exterior of the jacket 1.

As will be appreciated, the Velcro cover strip 6 and Velcro jacket strip 7 can be any size, shape or material.

The present invention further contemplates incorporating the safety harness into the interior lining of the jacket 1. In such a case, the access slot 8 will still operate in a similar manner to allow the attachment device to be exposed to the exterior of the jacket 1.

While the invention has been described in terms of various specific embodiments, those skilled in the art will recognize that the invention can be practiced with modification within the spirit and scope of the claims.

What is claimed is:

1. A jacket having an interior and exterior side, comprising:

an access slot located horizontally on a top half of a back side of said jacket; and a cover flap disposed over said access slot, said cover flap being completely removable from said jacket and being discretely detached from said cover flap;

wherein said access slot is operable to allow an attachment device of a safety harness to be accessed from said exterior side of said jacket;

wherein said access slot is reinforced;

wherein said jacket comprises an attachment assembly;

said attachment assembly having a first mechanism attached to said cover flap and a second mechanism attached to said jacket, wherein said first mechanism operable to engage said second mechanism to hold said cover flap securely against said jacket while allowing said attachment device to be exposed to the exterior side of said jacket.

2. The jacket of claim 1 wherein said first mechanism is operable to be unengaged from said second mechanism.

3. The jacket of claim 2 wherein said first and second mechanism are made from a hook and loop material.

4. The jacket of claim 2 wherein said first mechanism is a button and second mechanism is a matching slot.

5. The jacket of claim 1 wherein said safety harness is permanently attached to said interior side of said jacket.

6. The jacket of claim 1 wherein said safety harness is removably attached to said interior side of said jacket.

7. A clothing having an interior and exterior side, comprising:

an access slot located horizontally on a top half of a back side of said clothing; and a cover flap having four sides consisting of an upper side, a lower side, a right side and a left side, and at least partially removably attached to said clothing over said access slot;

wherein said access slot is operable to allow an attachment device of a safety harness to be accessed from said exterior side of said clothing;

wherein said cover flap non-removably attached to said clothing on at least three sides of said cover flap;

wherein said clothing comprises an attachment assembly;

said attachment assembly having a first mechanism attached to a lower side of said cover flap and a second mechanism attached to said clothing, wherein said first mechanism operable to engage said second mechanism to hold said cover flap securely against said clothing while allowing said attachment device to be exposed to the exterior side of said clothing.

8. The clothing of claim 7 wherein said cover flap is at least partially sewn to said clothing.

9. The clothing of claim 8 wherein said first mechanism is operable to be unengaged from said second mechanism.

10. The clothing of claim 9 wherein said first and second mechanism are made from a hook and loop material.

11. The clothing of claim 9 wherein said first mechanism is a button and second mechanism is a matching slot.

12. The clothing of claim 7 wherein the access slot is reinforced.

13. The clothing of claim 7 wherein said safety harness is permanently attached to said interior side of said clothing.

14. The clothing of claim 7 wherein said safety harness is removably attached to said interior side of said clothing.

* * * * *